US009874352B2

(12) United States Patent
Klein

(10) Patent No.: US 9,874,352 B2
(45) Date of Patent: Jan. 23, 2018

(54) HOOD FOR EMISSION CONTROL FOR FIREPLACE

(75) Inventor: Mark Klein, San Clemente, CA (US)

(73) Assignee: INNOVATIVE HEARTH PRODUCTS, LLC, Nashville, TN (US)

( * ) Notice: Subject to any disclaimer, the term of this patent is extended or adjusted under 35 U.S.C. 154(b) by 1535 days.

(21) Appl. No.: 12/835,619

(22) Filed: Jul. 13, 2010

(65) Prior Publication Data

US 2012/0012100 A1 Jan. 19, 2012

(51) Int. Cl.
*F24B 1/195* (2006.01)

(52) U.S. Cl.
CPC ..... *F24B 1/1955* (2013.01)

(58) Field of Classification Search
CPC .. F24C 15/20; F24C 15/2042; F24C 15/2071; F24C 15/2078; F24C 15/2085; F24C 15/2092
USPC ..... 126/550, 500, 307, 312, 77, 307 R, 546, 126/299 F, 299 D, 300; 110/203
See application file for complete search history.

(56) References Cited

U.S. PATENT DOCUMENTS 1,516,169 A * 11/1924 Wilkinson et al. ..... 126/315
2,052,453 A * 8/1936 Dollinger ..... 454/207
3,049,113 A * 8/1962 Northwood et al. ..... 126/520
3,496,335 A * 2/1970 Staats ..... 392/348
3,664,325 A * 5/1972 Malafouris ..... 126/531
3,724,443 A * 4/1973 Carson ..... 126/531
3,842,821 A * 10/1974 Juris ..... 126/512
3,880,139 A * 4/1975 Young ..... 126/9 R
4,026,264 A * 5/1977 Henriques ..... 126/528
4,102,319 A * 7/1978 Koopmeiners ..... 126/524
4,112,914 A * 9/1978 Brown ..... 126/502
4,117,827 A * 10/1978 Billmeyer ..... 126/535
4,200,086 A * 4/1980 Kolb ..... 126/66
4,270,513 A * 6/1981 Mitchelson ..... 126/502
4,416,253 A * 11/1983 Ickes ..... 126/292
4,424,794 A * 1/1984 Page ..... 126/500
4,495,933 A * 1/1985 Schinbeckler ..... 126/500
4,584,986 A * 4/1986 Cannata ..... 126/500
4,649,808 A * 3/1987 Ward et al. ..... 454/17
4,683,623 A * 8/1987 Cannata ..... 126/523
4,702,224 A * 10/1987 Griffith ..... 126/8
4,760,981 A * 8/1988 Hodges ..... 248/57
4,794,662 A * 1/1989 Parcher ..... 15/249.1
4,852,548 A * 8/1989 Shimek et al. ..... 126/518
(Continued)

*Primary Examiner* — Avinash Savani
(74) *Attorney, Agent, or Firm* — Arent Fox LLP

(57) ABSTRACT

A hood for directing smoke from a wood burning fireplace through a filter or catalytic converter enables a substantial reduction in pollutants released to the environment. In an exemplary embodiment, a hood includes a housing, in which an exhaust cleaner support unit supports an exhaust cleaner for reducing pollutants as smoke is directed from an intake opening of the housing to an exhaust opening of the housing. A rear surface of the housing and side surfaces of the housing abut three walls of the fireplace, reducing air paths behind or beside the hood to capture a substantial amount of the smoke from the fire. The front of the hood is tapered to direct the smoke toward the exhaust cleaner. Due to a mild suction effect from heating of the exhaust cleaner, the front surface of the hood need not extend all the way to the front of the fireplace, and air flow in front of the hood into the flue is not impeded.

10 Claims, 8 Drawing Sheets

(56) References Cited

U.S. PATENT DOCUMENTS 4,878,481 A * 11/1989 Schoeff et al. ..... 126/307 R
4,898,154 A * 2/1990 Richison ..... 126/500
4,924,850 A * 5/1990 Rieger ..... 126/500
5,263,470 A * 11/1993 Whitehouse ..... 126/500
5,299,558 A * 4/1994 Binzer ..... 126/512
5,347,983 A * 9/1994 Shimek ..... 126/529
5,377,666 A * 1/1995 Whitehouse ..... 126/500
5,419,307 A * 5/1995 Linkletter et al. ..... 126/307 R
5,536,206 A * 7/1996 Bodmer et al. ..... 454/65
5,575,274 A * 11/1996 DePalma ..... 126/512
5,590,641 A * 1/1997 Duong ..... 126/85 B
5,662,522 A * 9/1997 Waltz ..... 454/359
5,752,500 A * 5/1998 Jamieson et al. ..... 126/512
5,915,374 A * 6/1999 Susany ..... 126/500
6,006,744 A * 12/1999 Taylor ..... 126/543
6,024,085 A * 2/2000 Hodge et al. ..... 126/500
6,029,655 A * 2/2000 Hussong et al. ..... 126/515
6,039,041 A * 3/2000 Barth ..... 126/85 B
6,041,771 A * 3/2000 Hayes ..... 126/77
6,098,614 A * 8/2000 Fleming ..... 126/512
6,237,587 B1 * 5/2001 Sparling et al. ..... 126/500
6,286,502 B1 * 9/2001 Moberg ..... 126/500
6,543,440 B2 * 4/2003 Moberg ..... 126/500
6,863,064 B2 * 3/2005 Lyons et al. ..... 126/500
6,968,838 B1 * 11/2005 Tiegs ..... 126/500
7,066,170 B1 * 6/2006 Atemboski et al. ..... 126/518
7,140,364 B1 * 11/2006 Buffington ..... 126/500
7,275,929 B2 * 10/2007 Tiegs ..... 431/125
7,784,458 B2 * 8/2010 Richter et al. ..... 126/80
2002/0096171 A1 * 7/2002 Lyons et al. ..... 126/512
2004/0065318 A1 * 4/2004 Hadfield ..... 126/500
2005/0000510 A1 * 1/2005 Holt et al. ..... 126/500
2005/0247304 A1 * 11/2005 Weiss ..... 126/504
2006/0027231 A1 * 2/2006 Ng et al. ..... 126/299 R
2006/0042622 A1 * 3/2006 Searer ..... 126/299 R
2006/0112955 A1 * 6/2006 Reaves ..... 126/530
2007/0101987 A1 * 5/2007 Atemboski et al. ..... 126/518
2009/0017741 A1 * 1/2009 Arnold et al. ..... 454/35
2010/0186731 A1 * 7/2010 Murray ..... 126/502
2011/0088683 A1 * 4/2011 Spadaro ..... 126/500
2012/0204857 A1 * 8/2012 Goodson ..... 126/500
2012/0318255 A1 * 12/2012 Brown ..... 126/25 R

* cited by examiner

HOOD FOR EMISSION CONTROL FOR FIREPLACE

BACKGROUND OF THE INVENTION

Field

The present disclosure relates to fireplaces, and more particularly, to the reduction of air pollutants from wood burning fireplace emissions.

Background

Recently, the quality of the air has become a serious concern worldwide. Significant effort has been directed to the minimization of various forms of pollutants in the air we breathe. For example, numerous regulatory standards have been imposed on automobile exhaust; many apartment houses no longer have incinerators for burning their tenants' waste; and large garbage burning incinerators must meet established standards or be shut down.

These concerns apply equally to the emissions from a common residential fireplace. Several of the compounds produced during the combustion of wood are of great concern. The problem of air pollution caused by the compounds produced when wood burns has been recognized by many, and a growing number of federal, state, and local environmental agencies are implementing regulations related to wood burning devices.

Emission standards for a majority of combustion processes, including wood burning fireplaces, have been established by the United States Environmental Protection Agency. The pollutants regulated by this agency are numerous and varied, including particles of organic compounds, carbon monoxide, volatile organic compounds, and nitrous oxides.

One simple fireplace pollutant removal device includes a filter, a fan, and a smoke detector. In operation, the filter is placed in the flue, and the fan is positioned above the filter to draw the exhaust gases up through the filter. The smoke detector is mounted in front of the fireplace. Here, the smoke detector acts as a monitor of gases reflected from a clogged filter and provides an alarm when the filter needs cleaning. A method of removing the clogged filter provides a roll of thin filter-paper which is scrolled through the flue as segments of the filter-paper saturate with pollutants. Unfortunately, because the filter paper may be combustible, this pollutant removal device may be a fire hazard. Assuming that a fire is not caused by overheating the filter paper, when the paper clogs smoke will be emitted from the fireplace into the area adjacent to the wood burning chamber, creating a smoke hazard.

Another conventional fireplace pollutant filter utilizes a ceramic fiber duct positioned along the path of the flow of combustion products, between the combustion chamber and the flue. Here, a first duct portion promotes secondary combustion of unburned products of combustion and a second duct portion directs products of combustion from the front of the combustion chamber to the flue. Though some pollutants may be removed by this device by the secondary combustion, many may still enter the atmosphere due to an incomplete removal by the secondary combustion and the lax of pollutant removal from the combustion products flowing through the second duct.

Still further improvement to the removal of pollutants from fireplace emissions has been achieved with the use of a reticulated foam structure having its surface coated with a catalytic material that converts pollutants into relatively harmless compounds. For example, U.S. Pat. No. 6,237,587, incorporated herein by reference in its entirety, discloses such a catalyst enabling improved airflow from the smoke chamber into the flue. Here, in order to quickly raise the temperature of the catalytic material to a suitable temperature where the cleaning of the exhaust may be improved, the catalytic material includes heaters embedded in the reticulated foam structure for heating the catalyst temperature when the fire is not hot enough to heat the catalyst itself to a suitable temperature to catalyze the exhaust compounds.

Although there are many catalytic devices designed to reduce pollutants in fluid streams such as fireplace smoke exhaust, the backpressures created by these devices are generally too high to allow proper fireplace operation. The increased backpressure may hinder the fireplace's draw, causing a variety of unacceptable consequences, including smoke escaping into the house instead of up the chimney.

SUMMARY

The following presents a simplified summary of the disclosure in order to provide a basic understanding of certain disclosed embodiments. This summary is not an extensive overview of all contemplated embodiments, and is intended neither to identify key or critical elements, nor to delineate the scope of such embodiments. Its sole purpose is to present some concepts of certain disclosed embodiments in a simplified form as a prelude to a more detailed description, presented later.

In various representative aspects, the instant disclosure provides for an easily-installed hood that mounts in a fireplace enabling a substantial reduction in emissions by way of a filter and/or a catalytic converter.

In one aspect, the disclosure provides a hood for reducing exhaust pollutants from a fireplace. Here, the hood may include a housing having an intake opening and an exhaust opening, an exhaust cleaner support unit for supporting an exhaust cleaner in the housing between the intake opening and the exhaust opening, a rear surface configured to abut a rear wall of the fireplace, side surfaces configured to abut respective side walls of the fireplace, and a front surface tapered to direct fireplace emissions toward the exhaust cleaner.

Another aspect of the disclosure provides an air pollution reduction unit including a housing having an intake opening and an exhaust opening. Here, the air pollution reduction unit includes a first flange at the exhaust opening extending inward toward the exhaust opening, an exhaust cleaner support unit for supporting an exhaust cleaner between the intake opening and the exhaust opening, a rear surface configured to abut a rear wall of a fireplace, side surfaces configured to abut respective side walls of the fireplace, and a front surface configured to extend toward, but not to reach, a front of the fireplace.

These and other aspects are more fully comprehended upon review of this disclosure.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
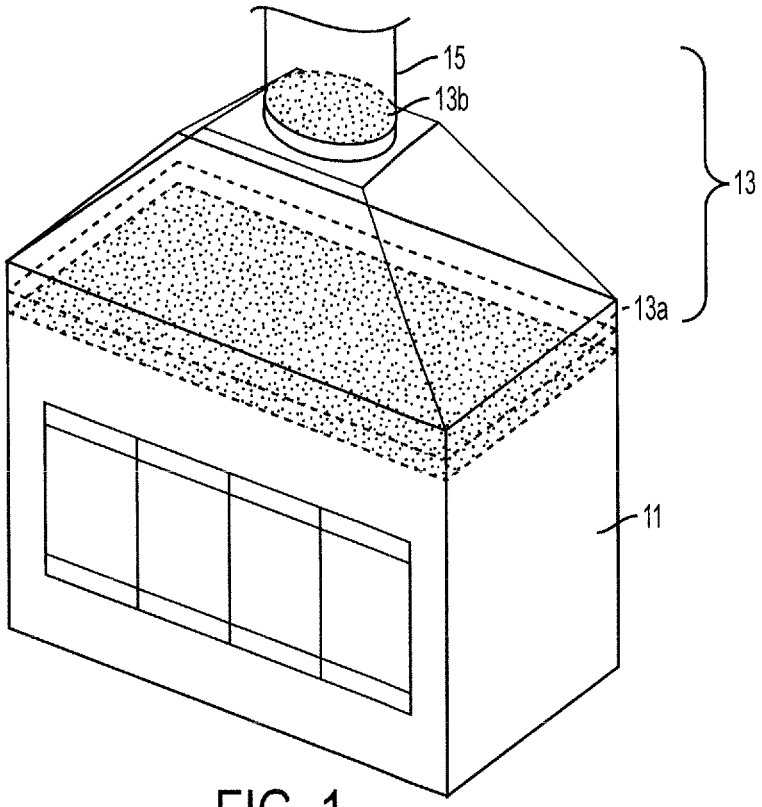
FIG. 1 PRIOR ART
FIG. 1 shows a conventional fireplace box having an emission cleaner.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

As used herein, the term, "exhaust cleaner," or any variation thereof, is generally intended to include anything that may reduce or remove undesired impurities from the exhaust from a fireplace, such as, for example: filters, exhaust reburners, catalytic converters; and/or the like.

FIG. 1 is an illustration of a prior art wood burning fireplace box 11 including an exhaust cleaner 13. According to various design specifications, the exhaust cleaner 13 may be located at a top portion of a smoke chamber between the fire and a flue 15, such as exhaust cleaner 13*a*; at a base of a flue 15, such as exhaust cleaner 13*b*; or at any other suitable location where the smoke from the fire substantially passes through the exhaust cleaner 13. According to various design considerations, a smaller exhaust cleaner may be desired when the material used demands substantial expense, while a larger exhaust cleaner may be desired to increase the air flow. Here, the exhaust cleaner 13 may be any suitable filter and/or catalytic converter material for physically and/or chemically cleaning the exhaust from the fireplace. When a fire is burning in the fireplace 11, exhaust gases from the burning process pass through the exhaust cleaner 13, wherein air pollutants present in the smoke emitted from the fire are removed and/or converted into relatively harmless compounds. After passing through the exhaust cleaner, a relatively non-polluting exhaust enters the flue 15 from which a relatively clean exhaust is emitted to the surrounding air. Thus, in the conventional fireplace having an exhaust cleaner 13, all of the emissions from the fireplace are forced to pass through the exhaust cleaner.

A wood burning fireplace is generally an open device. Consequently, there exists a relatively low differential draft pressure between the front of the fireplace and the flue. Therefore, an exhaust cleaner for use between the smoke chamber and the flue would be desired not to have a back pressure that drops the differential draft pressure below that which directs the smoke to the flue. Though reducing the size of pores in the exhaust cleaner may increase the internal surface area per cubic foot, improving the effectiveness of a filter or a catalytic converter, it may also increase the back pressure presented to the smoke, thus lowering the differential pressure and resulting in unwanted smoke in the home. Therefore, the porosity of the exhaust cleaner should be suitably chosen to prevent an unacceptable decrease of differential draft pressure.

In an aspect of the disclosure, an exhaust cleaner is suitably positioned such that heat from the fire may cause the temperature of the exhaust cleaner substantially to rise. For example, in an embodiment wherein the exhaust cleaner is a catalytic converter, the conversion of pollutants into less harmful compounds may be most effective at a certain, relatively high temperature. Thus, the exhaust cleaner may be placed in relatively close proximity to the location in the fireplace box where the fire burns. Furthermore, in some examples, the exhaust cleaner may include resistive heating elements to electrically heat the catalyst material to a suitable temperature to rapidly reach the desired temperature for the catalytic process to occur when a fire is started or when a fire is smoldering and less able to heat the exhaust cleaner by itself.

In such an example, the heated exhaust cleaner heats the air in the flue, which thereby rises out the flue due to its decreased weight relative to the cooler, ambient air. Thus, the differential draft pressure rises, creating a mild suction that draws air from the room into the fireplace through the exhaust cleaner and out the flue. Moreover, this mild suction draws smoke from the fire through the exhaust cleaner where it is cleaned.

In one aspect of the disclosure, an air pollution reduction unit may be a part of a passive system. In this way, a user may continue to burn a fire in their fireplace in the same way as prior to the installation of the air pollution reduction unit. In a further aspect, the air pollution reduction unit may be hidden so that it may not be visible after it is installed.

Figure 2:
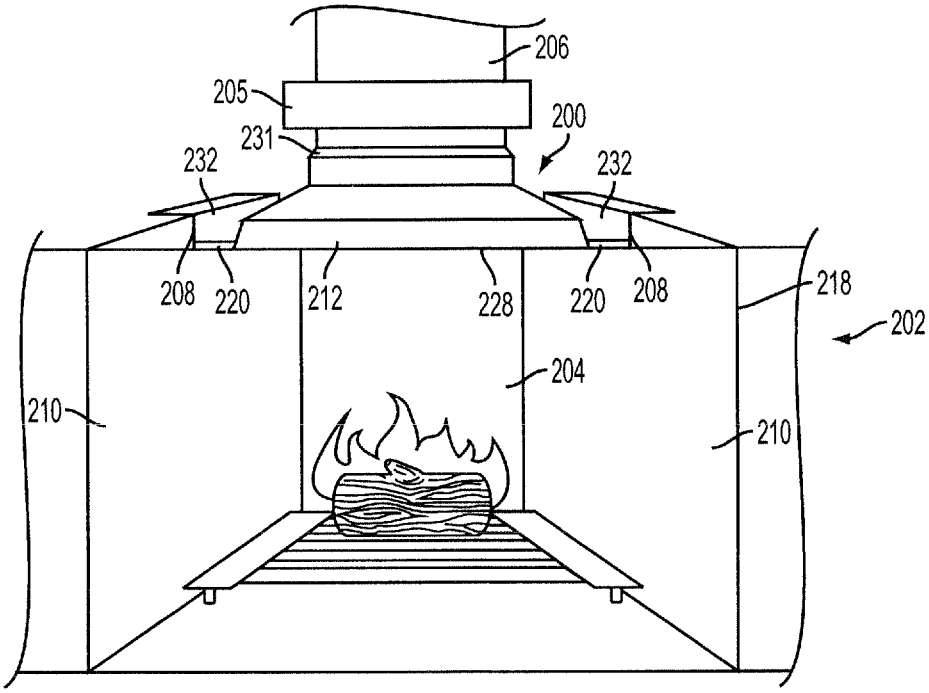
FIG. 2 is an illustration of a zero-clearance fireplace having a hood for reducing fireplace exhaust pollutants in accordance with an exemplary aspect of the disclosure.

In the exemplary embodiments discussed below, a hood for directing fireplace exhaust through an exhaust cleaner is mounted in a fireplace 202 having a substantially trapezoidal cross-section, as illustrated in FIG. 2. However, it should be apparent to those of ordinary skill in the art that the shape of the fireplace may differ from that discussed in a particular application, and other embodiments are generally adapted to the shape of the fireplace in those applications, without departing from the scope of the instant disclosure and the appended claims.

An apparatus for reducing pollutants from emissions from a fireplace 202 may operate in conjunction with a hood 200. Referring now to FIG. 2, a hood 200 in accordance with an exemplary embodiment is shown installed in a zero clearance wood burning fireplace 202. In the illustration, the front doors and façade are not illustrated for reasons of clarity; however, in some embodiments a front wall or façade may substantially hide the hood 200 from view during operation.

Figure 3:
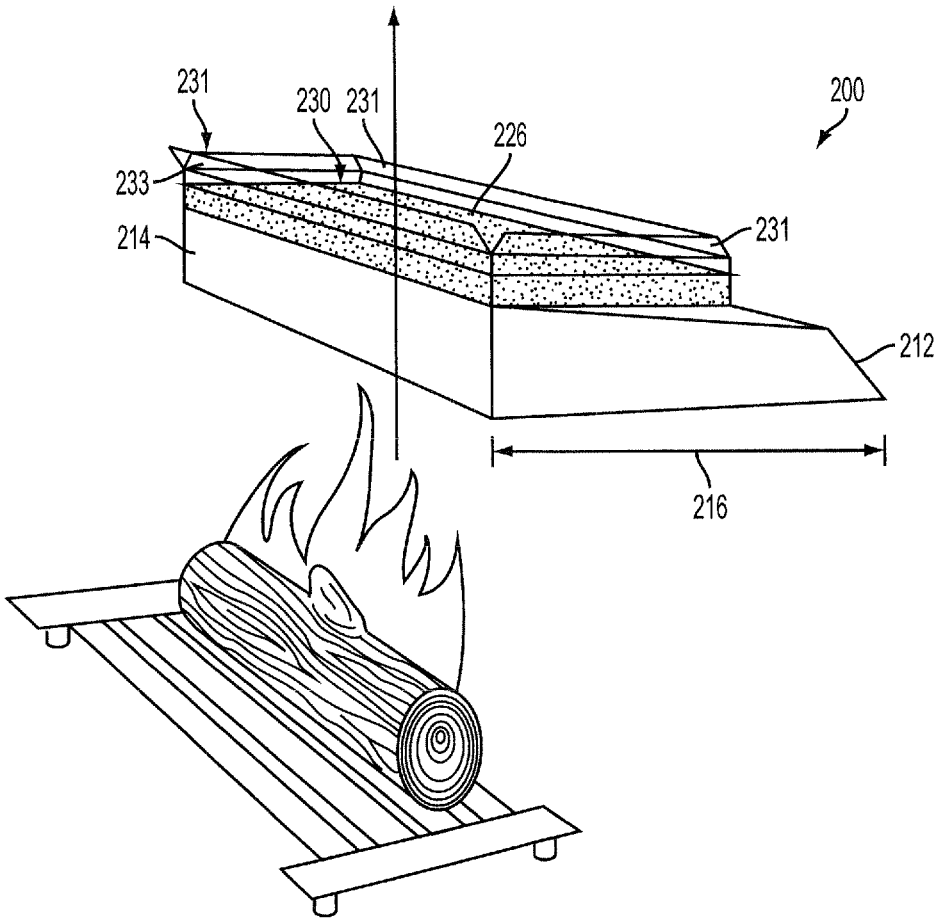
FIG. 3 is a conceptual diagram showing a rear of a hood for reducing fireplace exhaust pollutants in accordance with an exemplary aspect of the disclosure.

In an exemplary embodiment, an adjustable hood 200 is mounted at a rear wall 204 of the fireplace 202, below the damper 205 and the flue 206. In this way, the damper 205 may still be opened and closed without being obstructed. Here, the rear surface (214; see FIG. 3) and side surfaces 208 of the hood may abut the rear wall 204 and side walls 210 of the fireplace, respectively, while the front surface 212 of the hood may be substantially open. The hood 200 is adapted for directing a flow of emissions from a fire in the fireplace 202 into an exhaust cleaner 226 (see FIG. 3) to reduce pollutants from the exhaust before venting the emissions to the atmosphere.

In order to reduce or limit the ability for smoke to escape behind the rear surface 214 of the hood along the rear wall 204, the rear surface 214 of the hood may be adapted to abut the rear wall 204 of the fireplace. For example, the rear surface 214 may lay substantially flat or flush with the rear wall 204; an edge of the rear surface 214 may abut the rear wall 204; or one or more portions of the rear surface 214 may abut the rear wall 204. However, due to the pressure differential as discussed above due to heating of the exhaust cleaner 226, it generally is not necessary that any portion of the rear surface 214 tightly conform to any irregularities in the rear wall 204, such as those that might be caused by grout lines between bricks, rough surfaces, or the like, or even that the rear surface 214 directly contact the rear wall 204 of the fireplace. Similarly, the side surfaces 208 of the hood may be angled to abut the side walls 210 of the fireplace to reduce or limit the ability for smoke to escape around the hood 200. However, the side surfaces 208 need not necessarily form an air-tight seal against the side walls 210 of the fireplace. As discussed above, the mild suction effect may substantially pull the smoke into the hood 200 even if an air-tight seal is not formed at the rear and side walls of the fireplace.

Moreover, in the illustrated example, the front surface 212 of the hood is generally open, that is, it does not abut any wall or surface of the fireplace 202. Nonetheless, as discussed in further detail below the front surface 212 may be configured, e.g., angled in such a way as to direct rising emissions from the fire toward the exhaust cleaner 226.

As illustrated in FIGS. 2 and 4A-4D, the hood 200 may be adjustable, in that it may include extending arms 220 for adjusting the horizontal dimension of the hood 200 to reach the side walls 210 of a variety of sizes of fireplace 202. Here, the extending arms 220 extend horizontally from side portions 224 of the hood, wherein, as discussed in further detail below the side portions 224 may be configured, e.g., angled in such a way as to direct the rising emissions from the fire toward the exhaust cleaner 226.

Figure 4A:
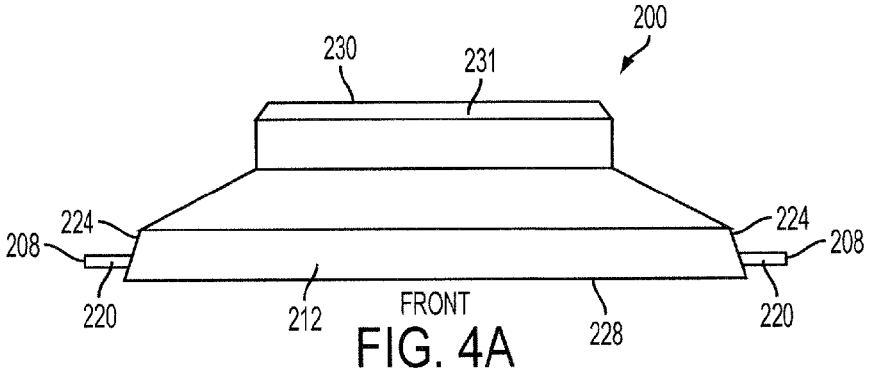
FIGS. 4A-4D are conceptual drawings showing multiple views of an adjustable hood for reducing fireplace exhaust pollutants in accordance with an exemplary aspect of the disclosure.
Figure 4B:
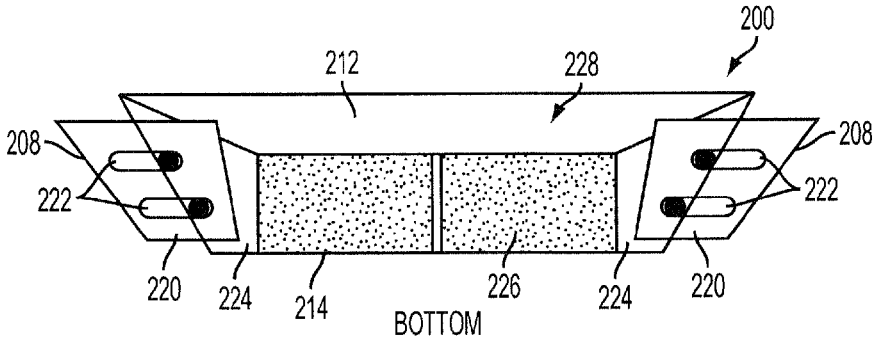
Figure 4C:
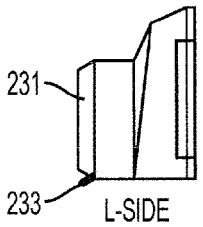
Figure 4D:
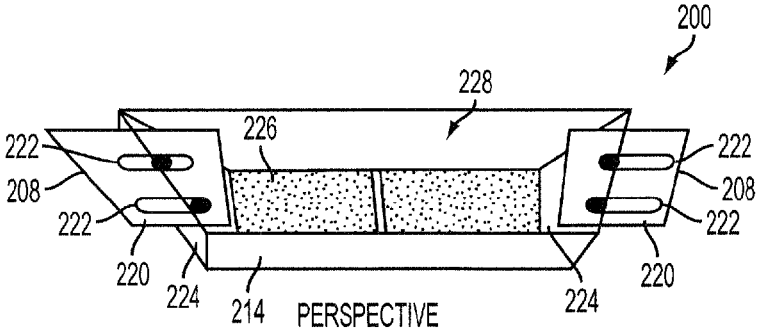

For example, some embodiments may have a plurality of width settings such that the hood is adjustable for a certain predetermined number of sizes of fireplaces. Here, the extending arms 220 may include a certain number of pre-drilled holes (not illustrated) where the extending arms 220 may be fixed to the hood 200 by tightening a screw or bolt and nut in the pre-drilled holes at predetermined locations corresponding to predetermined sizes of fireplace. Other examples may have a continuously variable adjustability such that the hood is adjustable for any size fireplace within a certain minimum and maximum range. For example, as illustrated in FIGS. 4B and 4C, the extending arms 220 may include one or more slots 222 so that the extending arms 220 may slide in or out within a certain range, and screws or nuts and bolts may be tightened to fix the extending arms 220 in a suitable location when the hood 200 substantially fits within the desired fireplace.

The front surface 212 and side portions 224 may be configured to result in an upside-down funnel shape that gathers the smoke emissions from the fire as they are drawn into the exhaust cleaner 226. For example, the front surface 212 and the side surfaces 224 may extend downward from the exhaust cleaner 226 having a suitable angle to broaden the area from whence smoke is drawn into a relatively smaller exhaust cleaner 226. In a design where the exhaust cleaner 226 includes an expensive material such as a reticulated foam coated in a catalyst material, the size of the exhaust cleaner 226 may be a primary design consideration when looking for an exhaust cleaning apparatus. Thus, the funnel shape of the hood 200 enables the efficient collection of a greater amount of the emissions from the fire while enabling a reduced size exhaust cleaner 226.

Here, as the smoke sits within the hood 200 at the underside of the exhaust cleaner 226, small eddies of the smoke may occur while the smoke is being drawn into the exhaust cleaner 226. Thus, the front surface and side portions of the hood may extend downward below the exhaust cleaner 226 a suitable distance to allow the smoke to gather and eddy prior to being drawn into the exhaust cleaner 226. In one nonlimiting example, the distance from the surface of the exhaust cleaner 226 to the bottom ends of the hood may be about two inches.

In some examples, the front-to-back dimension 216 (see FIG. 3) of the hood may be substantially less than the distance from the front 218 of the fireplace to the rear wall 204 of the fireplace. In this way, as the air flow through the opened damper 205 to the flue 206 may be open in front of the front surface 212 of the hood, overall air flow may be improved by minimizing this dimension 216. However, the dimension 216 should be chosen such that it substantially captures the emissions from the fire in the fireplace 202. In one nonlimiting example, the front-to-back dimension 216 may be about six to eight inches.

As the fire burns in the fireplace 202, the smoke may enter the hood 200 at an intake opening 228, pass through the exhaust cleaner 226, and exit via an exhaust opening 230. In general, it is not necessary that an air path through the hood 200 be the only path for air to enter the flue 206. That is, in some embodiments any air that rises in front of the front surface 212, or between the rear surface 214 or side surfaces 208 and the rear wall 204 or side walls 210 of the fireplace may enter the flue. Therefore, in some embodiments, the exhaust opening 230 of the hood 200 may not be directly connected to the damper 205 or the flue 206. Thus, while it may be possible that some smoke rising from the fire may escape cleaning by the exhaust cleaner 226, as discussed above, the configuration including the mild suction is such that a sufficient portion, if not all, of the smoke passes into the hood 200 and through the exhaust cleaner 226 to as to substantially reduce unwanted pollution from the exhaust to the external environment. Moreover, when it is not required for the exhaust opening of the hood 200 to be directly connected to the flue, installation of an aftermarket hood 200 into an existing fireplace 202 may be eased.

Figure 6:
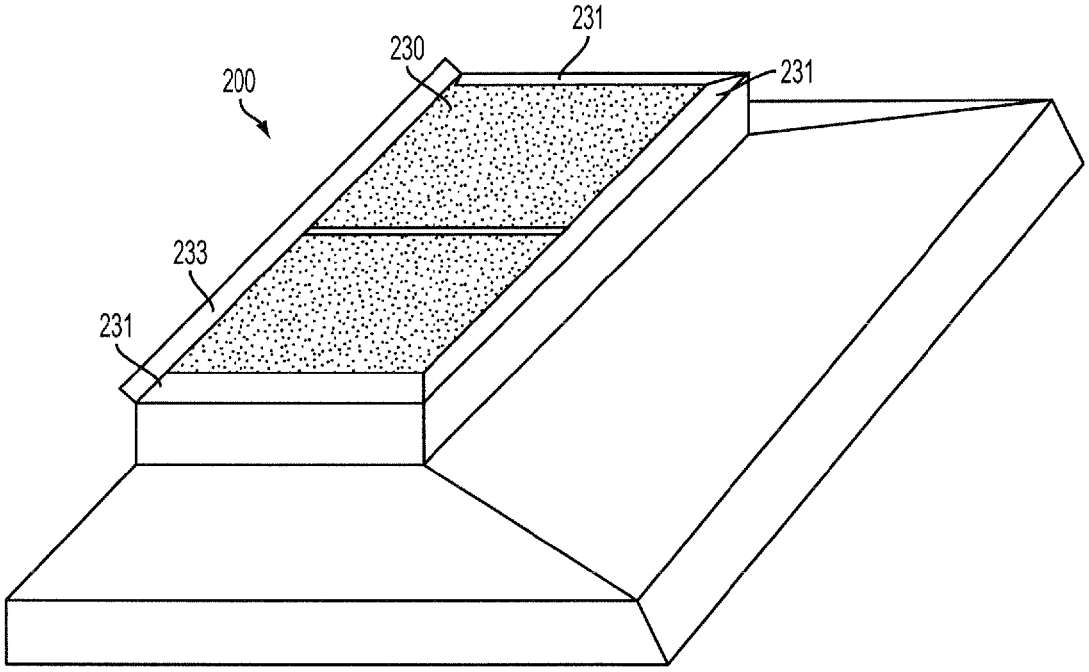
FIG. 6 is a perspective view of a hood for reducing fireplace exhaust pollutants in accordance with an exemplary aspect of the disclosure.

In some embodiments, as illustrated in FIG. 6, the exhaust opening 230 may include flanges 231 angled inward toward the flue 206 for improving the air flow from the hood 200 to the flue 206. In certain embodiments, the portion of the exhaust opening 230 adjacent to the rear surface 214 of the hood may have a flange 233 angled outward from the exhaust opening 230, such that it abuts the rear wall of the fireplace. In this way, any airflow behind the rear surface of the hood may be further reduced or eliminated due to the angled flange better blocking the flow of air behind the hood.

The hood 200 may be an aftermarket unit, adapted to be installed into an existing wood burning fireplace. That is, in some embodiments, the hood 200 may be provided as a unit to be installed into a user's existing fireplace. In other embodiments, the hood may be integrated into a fireplace upon its construction.

Figure 5A:
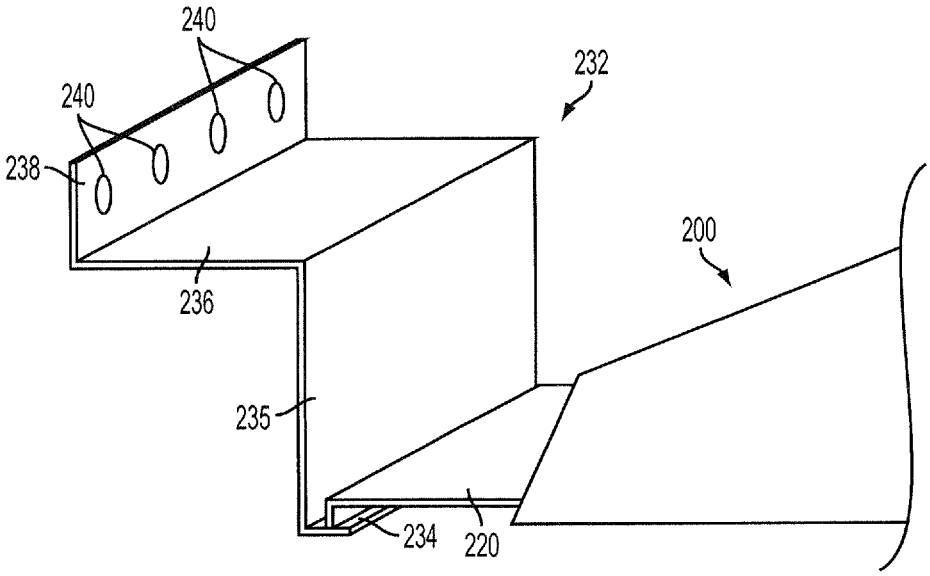
FIGS. 5A-5B are conceptual drawings showing views of a zero-clearance mounting bracket for mounting a hood for reducing fireplace exhaust pollutants in accordance with an exemplary aspect of the disclosure.
Figure 5B:
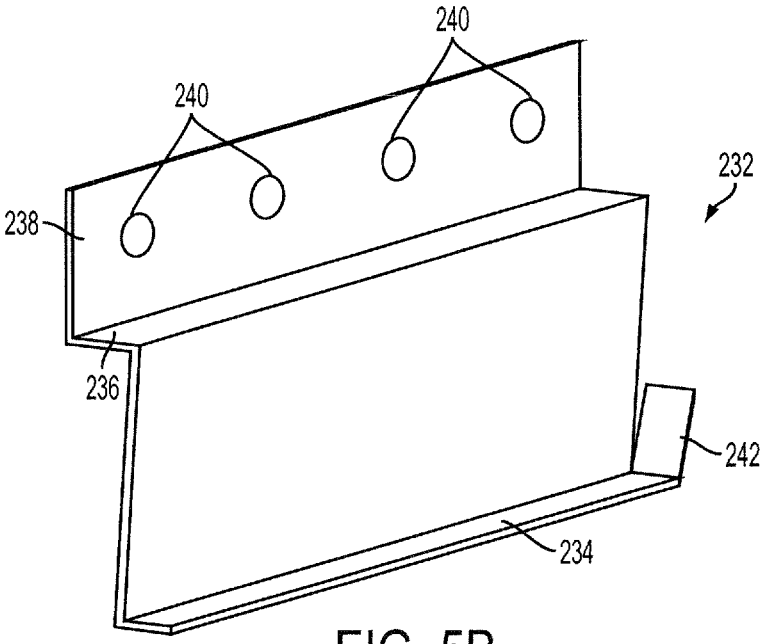

Returning to the embodiment illustrated in FIG. 2, an aftermarket hood 200 may be installed into a zero clearance fireplace 202 by way of zero clearance brackets 232. FIGS. 5A-5B illustrate closer detail of a zero clearance bracket 232. In the illustrated example, the zero clearance bracket 232 includes a flange 234 on which the extending arm 220 may be placed when the hood 200 is installed, and a riser 235 having a suitable length to position the hood 200 at a desired height within the fireplace. The zero clearance bracket 232 further includes a ledge 236 for supporting the weight of the hood 200 and a mounting surface 238 that includes one or more holes 240 into which screws or fasteners may be used to fasten the zero clearance bracket to the zero clearance fireplace. Here, installation of the hood 200 is facilitated by the initial mounting of the zero clearance brackets 220 into the zero clearance fireplace. When the zero clearance brackets 220 are installed, the hood may be easily slid into place by engaging the extending arms 220 with the flange 234 and sliding the hood 200 into place. Here, the flange 234 may include a stop 242 at a rear portion of the zero clearance bracket for stopping the sliding of the hood 200 at a suitable location.

Figure 7A:
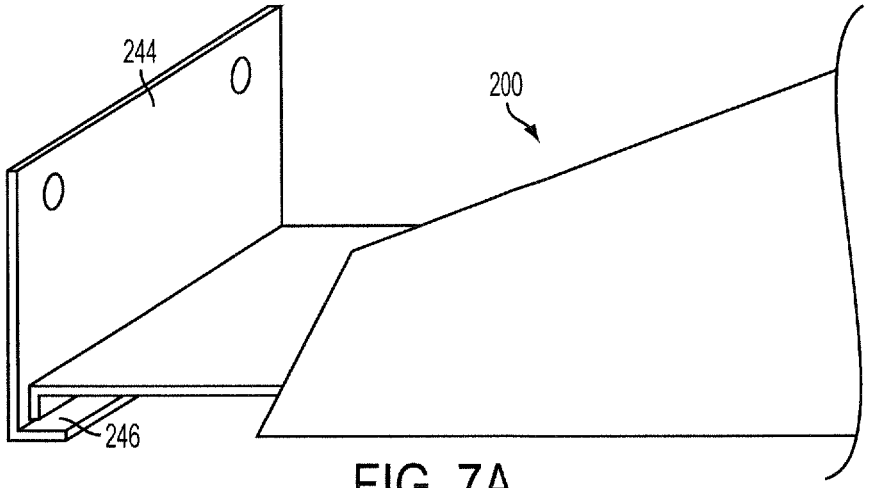
FIGS. 7A-7B are conceptual drawings showing views of a masonry bracket for mounting a hood for reducing fireplace exhaust pollutants in accordance with an exemplary aspect of the disclosure.
Figure 7B:
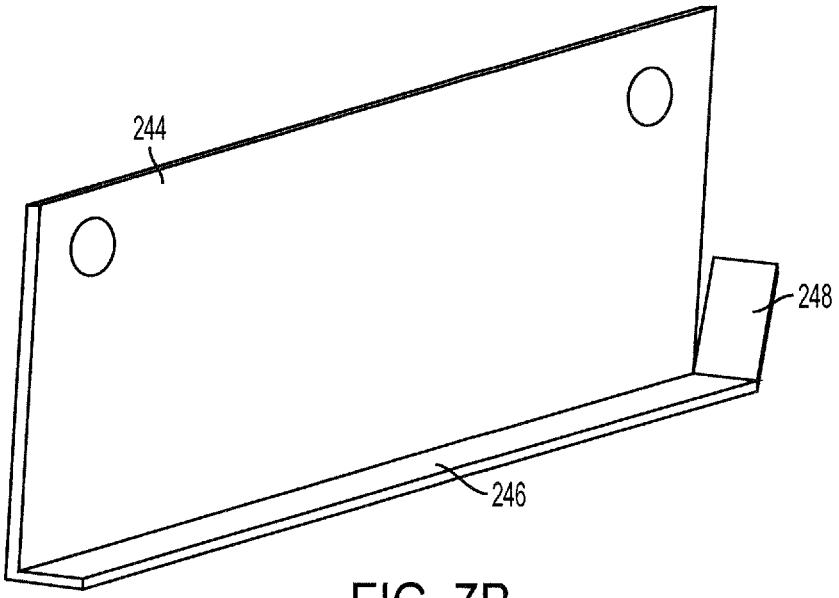

In another example, the aftermarket hood 200 may be installed into a more conventional fireplace having masonry walls by way of masonry brackets 244, as illustrated in FIG. 7A-7B. Here, the masonry bracket 244 includes a flange 246 on which the extending arm 220 may be slid into place, and a stop 248 for stopping the sliding of the hood 200 at a suitable position.

Figure 8A:
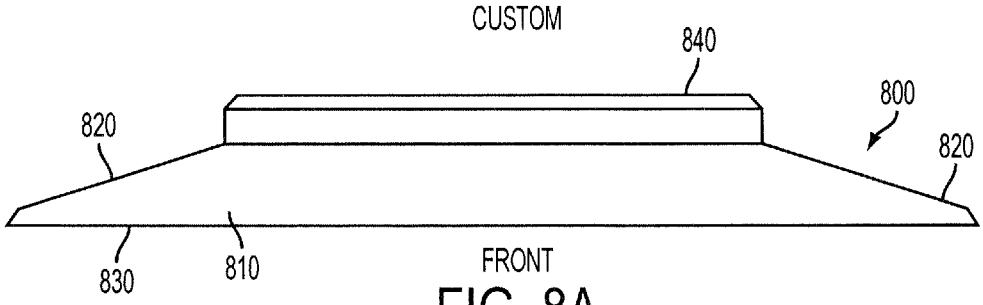
FIG. 8A-8B are conceptual drawings showing views of a fixed-size hood reducing fireplace exhaust pollutants in accordance with an exemplary aspect of the disclosure.
Figure 8B:
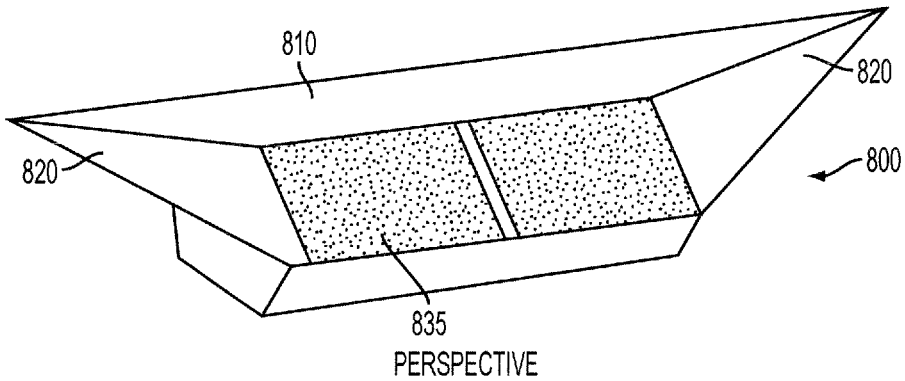

Although the above examples have related to an adjustable hood 200, in some other embodiments the hood may have a fixed size adapted for a particular size fireplace. For example, FIG. 8 illustrates a fixed-size hood 800 configured for a particular size fireplace. Because the fixed-size hood 800 includes many similar portions as those of the adjustable hood 200, some of the similar portions are not described in detail. The exact dimensions of the hood may be adapted to suit essentially any size fireplace and may be mounted in a substantially similar manner as the adjustable hood discussed above. The fixed-size hood 800 may include a front surface 810 and side surfaces 820 having a suitable angle to form an upside-down funnel shape for directing upward-bound smoke from an intake opening 830 through an exhaust cleaner 835 and out an exhaust opening 840. In a similar way as that described above for the adjustable hood 200, the fixed-size hood 800 may be mounted at a rear wall of a fireplace, above the smoke chamber and below the damper and the flue. Further, the fixed-size hood may be mounted on zero-clearance brackets 232 and/or masonry brackets 244 in substantially the same way as discussed above with the adjustable hood 200.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. An air pollution reduction unit comprising:

a hood having an open top and an open bottom, the hood comprising a front surface, a rear surface, and first and second opposing side portions connecting the front surface to the rear surface, the bottom of the hood defining an intake opening;

an exhaust cleaner support unit having an open top and an open bottom, the bottom of the exhaust cleaner support unit disposed on the top of the hood and the top of the exhaust cleaner support unit defining an exhaust opening; and first and second adjustable hood supports, each hood support extending from the first and second side portions, respectively.

2. The air pollution reduction unit of claim 1 wherein the front surface is inwardly tapered between the open bottom and open top of the hood.

3. The air pollution reduction unit of claim 1, further comprising first and second mounting brackets attached to the first and second extending arms, respectively.

4. The air pollution reduction unit of claim 3, wherein the first and second mounting brackets each comprise a ledge.

5. The air pollution reduction unit of claim 1, wherein the hood is an aftermarket unit configured to be installed in the fireplace.

6. The air pollution reduction unit of claim 1, further comprising a catalyst material for accelerating a chemical reaction to reduce the exhaust pollutants from the fireplace disposed in the exhaust cleaner support unit.

7. An air pollution reduction unit comprising:

a hood having an open top and an open bottom, the hood comprising a front surface, a rear surface, and first and second opposing side portions connecting the front surface to the rear surface, where the bottom of the hood defining an intake opening;

an exhaust cleaner support unit having an open top and an open bottom, the bottom of the exhaust cleaner support unit disposed on the top of the hood and the top of the exhaust cleaner support unit defining an exhaust opening; and a first flange at the exhaust opening, the first flange extending inwards toward the exhaust opening.

8. The air pollution reduction unit of claim 7, further comprising a second flange at the exhaust opening, the second flange extending outwardly from the exhaust opening.

9. The air pollution reduction unit of claim 7, wherein the side portions and the front surface are each tapered inward to form an upside-down funnel shape.

10. The air pollution reduction unit of claim 9, wherein the side portions and the front surface each extend downward from the exhaust cleaner support unit by about two inches.

* * * * *